US005956920A

United States Patent [19]

Davis

[11] Patent Number: 5,956,920

[45] Date of Patent: Sep. 28, 1999

[54] MODULAR POST CLADDING ELEMENT, POST CLADDING ASSEMBLY, AND METHOD OF CLADDING A POST

[75] Inventor: Harry H. Davis, Mooresville, N.C.

[73] Assignee: L.B. Plastics Limited, United Kingdom

[21] Appl. No.: 08/917,409

[22] Filed: Aug. 25, 1997

[51] Int. Cl.[6] ..... E04C 3/30

[52] U.S. Cl. ..... 52/736.3; 52/236.1; 52/588.1

[58] Field of Search ..... 52/736.3, 736.4, 52/736.6, 738.1, 732.1, 732.2, 737.2, 730.4, 723.1, 98, 100, 581, 588.1, 730.5, 731.3

[56] References Cited

U.S. PATENT DOCUMENTS

| | | | |
|---|---|---|---|
| 3,413,775 | 12/1968 | Katz | 52/737.4 |
| 3,810,337 | 5/1974 | Pollard | 52/737.4 X |
| 4,021,987 | 5/1977 | Schnebel | 52/737.4 X |
| 4,467,584 | 8/1984 | Crites et al. | 52/737.4 |
| 5,222,344 | 6/1993 | Johnson | 52/728 |
| 5,335,471 | 8/1994 | Kupiec | 52/737.4 |

OTHER PUBLICATIONS

Author: AFCO Industries, Inc.; Title of Article: Afco Aluminum Columns; Title of Item: N/A; Date: Publication date was prior to the date this application was filed; Pages: Entire brochure; Publisher: N/A; Country Where Published: N/A; Source: N/A.

*Primary Examiner*—Beth Aubrey
*Attorney, Agent, or Firm*—Adams Law Firm, P.A.

[57] ABSTRACT

An elongate modular post cladding element for being assembled with a plurality of like elements to cover a post. The cladding element includes a panel for being applied to one side of the post, and having first and second opposed end edges and first and second opposed, longitudinally-extending side edges. A female fastener extending along the first side edge of the panel. A complementary male fastener extends along the opposed second side edge of the panel, and is adapted for cooperating with a female fastener of a like, adjacent cladding element for locking the two cladding elements together on the post.

3 Claims, 6 Drawing Sheets

MODULAR POST CLADDING ELEMENT, POST CLADDING ASSEMBLY, AND METHOD OF CLADDING A POST

TECHNICAL FIELD AND BACKGROUND OF THE INVENTION

This invention relates to a modular post cladding element, post cladding assembly, and method of cladding a post. The invention is especially applicable for cladding standard size square posts used for supporting outdoor structures such as decks, porches, boat piers, and fences. The invention is essentially maintenance free, is quickly and easily applied to the post, and is adjustable to accommodate minor size variations in the post.

One post cladding of the prior art is integrally formed in a square sleeve which is applied over the top of the post and permanently attached to the post using nails or other fasteners. Unlike the present invention, this prior art product may not properly conform to sides of the post which may be slightly more or less wide than expected. For example, a 6" square wood post may have one side which is only 5¼" and another which is 5¾". A sleeve-type cladding as described above would not properly fit this post. Furthermore, the fasteners used for permanently attaching the prior art cladding to the post are exposed and therefore detract from the overall appearance of the post.

The present invention overcomes these and other problems of the prior art by providing a cladding assembly which includes several interconnecting, adjustable cladding elements arranged around the post to custom-fit each side of the post. The cladding element and assembly are suitable for covering a post during new construction and to retrofit an existing post. In addition, the fasteners used for permanently attaching the cladding elements to the post are concealed to further enhance the appearance of the post.

SUMMARY OF THE INVENTION

Therefore, it is an object of the invention to provide a post cladding assembly which improves the appearance and whether-resistance of the post.

It is another object of the invention to provide a post cladding assembly which requires relatively little maintenance.

It is another object of the invention to provide a post cladding element which is quickly and easily applied to the post.

It is another object of the invention to provide a post cladding assembly which is adjustable to accommodate slight size variations in the post.

It is another object of the invention to provide a post cladding assembly which is applicable to retrofit an existing post.

It is another object of the invention to provide a post cladding element which interconnects with like elements to form a cladding assembly.

It is another object of the invention to provide a post cladding assembly which is attached with concealed fasteners for permanently attaching the cladding assembly to the post.

It is another object of the invention to provide a post cladding assembly and element which is adapted to fit varying wood sizes.

It is another object of the invention to provide a post cladding assembly and element which can be formed to clad any size post, such as 4", 6", 8" or 10" square posts.

It is another object of the invention to provide a method of quickly and easily cladding a post.

These and other objects of the present invention are achieved in the preferred embodiments disclosed below by providing an elongate modular post cladding element for being assembled with a plurality of like elements to cover a post. The cladding element includes a panel for being applied to one side of the post, and having first and second opposed end edges and first and second opposed, longitudinally-extending side edges. A female fastener extends along the first side edge of the panel. A complementary male fastener extends along the opposed second side edge of the panel, and is adapted for cooperating with a female fastener of a like, adjacent cladding element for locking the two cladding elements together on the post.

According to one preferred embodiment of the invention, the female fastener includes spaced-apart walls defining a slot having a generally U-shaped profile for receiving a male fastener of a like, adjacent cladding element.

According to another preferred embodiment of the invention, the depth of the slot is at least twice as great as the width of the slot to define a lateral adjustment zone. The male fastener of the adjacent like cladding element extends into the adjustment zone a distance sufficient to accommodate the lateral positioning of the adjacent like cladding element on the post.

According to yet another preferred embodiment of the invention, the slot of the female fastener includes a plurality of serrations adapted for frictionally engaging the male fastener of the adjacent cladding element received in the slot.

According to yet another preferred embodiment of the invention, the male fastener includes a plurality of serrations adapted for frictionally engaging the female of the like adjacent cladding element.

According to yet another preferred embodiment of the invention, the male and female fasteners extend longitudinally from one end edge of the panel to the other.

According to yet another preferred embodiment of the invention, the male and female fasteners are integrally-formed with the panel.

According to yet another preferred embodiment of the invention, the male fastener includes at least one longitudinally-extending groove therein defining a weakness line for being cut to shorten the lateral dimension of the cladding element.

According to yet another preferred embodiment of the invention, a longitudinally-extending attachment flange is formed adjacent the female fastener for receiving attachment means therethrough to the post for permanently mounting the cladding element to the post.

According to yet another preferred embodiment of the invention, the panel includes at least one longitudinally-extending channel for allowing air circulation and water drainage in the space between the cladding element and post.

According to yet another preferred embodiment of the invention, the cladding element is integrally-molded of a plastic material.

In another embodiment of the invention, a post cladding assembly includes a plurality of like post cladding elements for covering a post. Each of the post cladding elements includes a panel for being applied to one side of the post. The panel has first and second opposed end edges and first and second opposed, longitudinally-extending side edges. A female fastener extends along the first side edge of the panel.

A complementary male fastener extends along the opposed second side edge of the panel, and cooperates with a female fastener of an adjacent cladding element for locking the two cladding elements together on the post.

A method of cladding a post according to one embodiment of the invention includes the steps of forming a post cladding element having a panel for being applied to one side of the post. The panel has first and second opposed end edges and first and second opposed, longitudinally-extending side edges. A female fastener extends along the first side edge of the panel. A complementary male fastener extends along the opposed second side edge of the panel. At least two of the post cladding elements are applied to the post such that the first side edge of one cladding element is adjacent the second side edge of another cladding element. Respective male and female fasteners of the adjacent cladding elements are locked together on the post.

According to one preferred embodiment of the invention, decorative molding is applied to a top of the post adjacent the first end edge of each cladding element.

According to another preferred embodiment of the invention, decorative molding is applied around a base of the post adjacent the second end edge of each cladding element.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
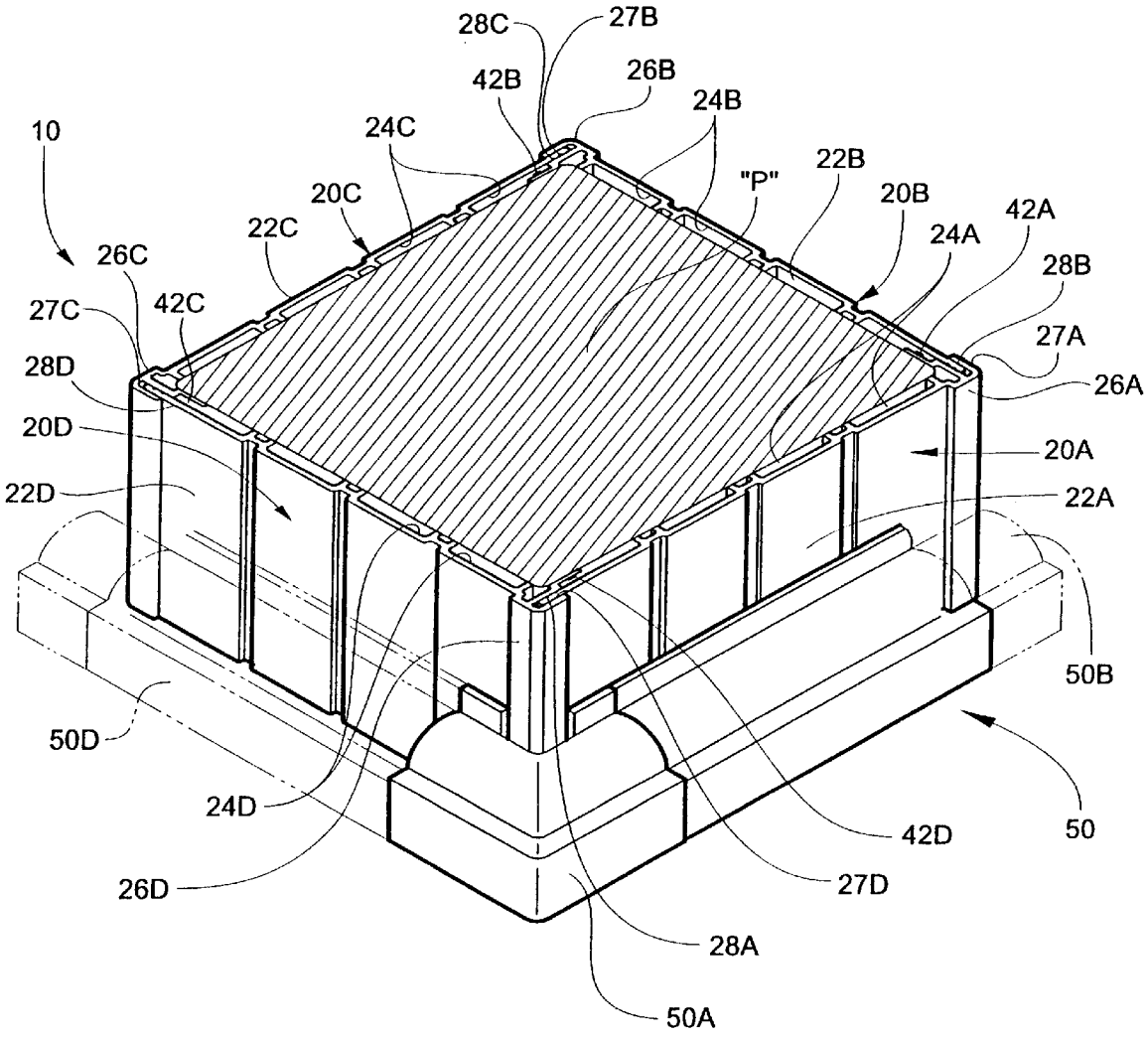
FIG. 1 is a fragmentary, perspective view of the post cladding assembly according to one preferred embodiment of the invention as applied to a square post.

Referring now specifically to the drawings, a post cladding assembly according to the present invention is illustrated in FIG. 1 and shown generally at reference numeral 10. The cladding assembly 10 has particular application to standard square posts commonly used in outdoor decks, porches, boat piers, and fences. The cladding assembly 10 is formed of four elongate, modular post cladding elements 20A, 20B, 20C, and 20D adapted for covering respective sides of the post "P" to provide an aesthetic, generally maintenance-free exterior. The post cladding elements 20A–20D are preferably individually formed of extruded, U.V. stabilized, high-impact rigid PVC.

Figure 2:
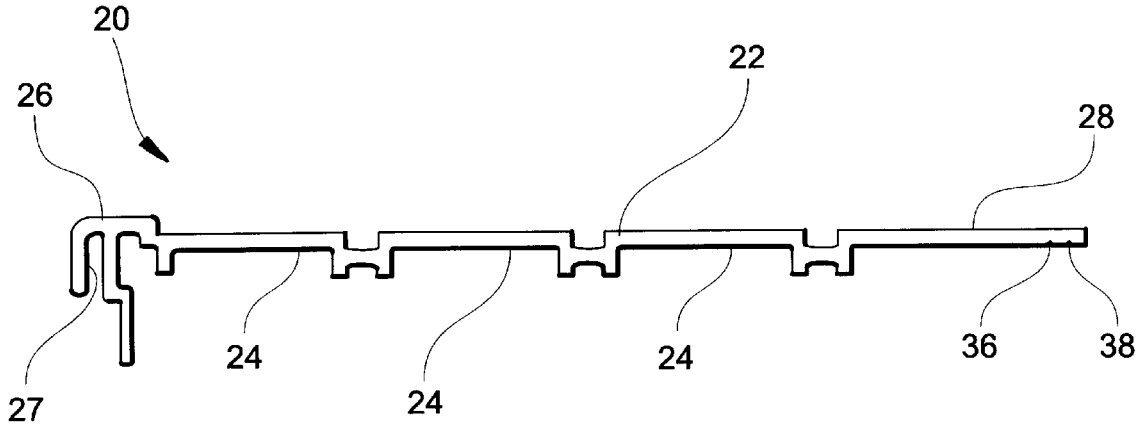
FIG. 2 is an end view of a single post cladding element.

A single post cladding element 20 according to the invention is shown in FIG. 2. The cladding element 20 includes a panel 22 having first and second end edges and first and second opposed, longitudinally-extending side edges. Preferably, the panel 22 includes spacers cooperating with the post "P" to form vertical channels 24 extending from one end edge of the panel 22 to the other to allow water drainage and air circulation in the space between the cladding element 20 and post "P".

A female fastener 26 is integrally-formed along the first side edge of the panel 20, and includes spaced walls defining a slot 27 oriented generally perpendicular to the plane of the panel 22. A complementary male fastener 28 is integrally-formed along the opposed second side edge of the panel 22, and cooperates with a female fastener of a like, adjacent cladding element to lock the two cladding elements together on adjacent sides of the post "P". Preferably, the female fastener 26 and male fastener 28 extend the entire length of the panel 22, and include respective serrations 32 and 34 for frictionally holding the adjacent cladding elements 20 together.

Figure 3:
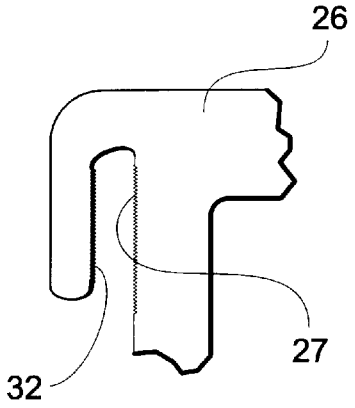
FIG. 3 is an enlarged view of the integrally-formed female fastener of the post cladding element.
Figure 5A:
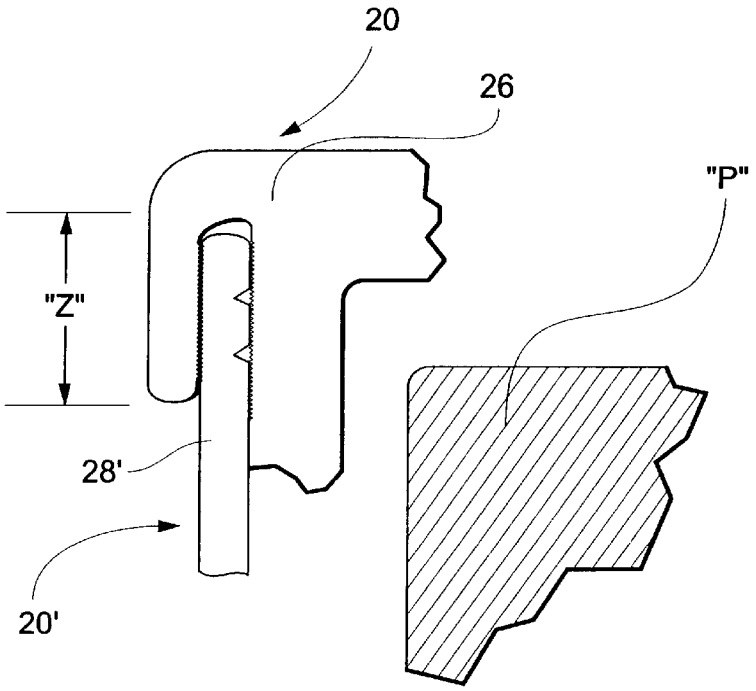
FIG. 5A is an enlarged view of the male fastener of one cladding element inserted into the female fastener of an adjacent, like cladding element, and showing the male fastener in a first position in the adjustment zone of the slot.
Figure 5B:
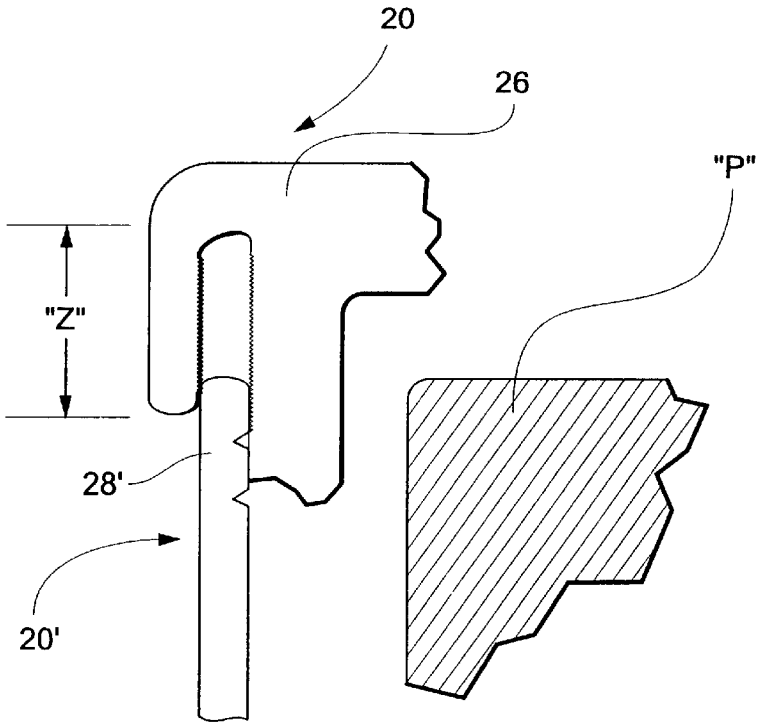
FIG. 5B is an enlarged view of the male fastener of one cladding element inserted into the female fastener of an adjacent, like cladding element, and showing the male fastener in a second position in the adjustment zone of the slot.

Referring to FIGS. 3, 5A, and 5B, the slot 27 of the female fastener 26 has a generally U-shaped profile adapted for receiving the male fastener 28' of an adjacent cladding element 20'. The depth "y" of the slot 27 is preferably about 3–4 times greater than the width "x", such that the amount of male fastener 28' received into the slot 27 can be adjusted within an adjustment zone "z" for increasing or decreasing the lateral coverage of the cladding element 20' on the post "P".

The adjustment zone "z" is best illustrated in FIGS. 5A and 5B. FIG. 5A shows the male fastener 28' of the adjacent cladding element 20' entirely received in the slot 27 of the female fastener 26 for reduced lateral coverage of cladding element 20' over the side of the post "P". FIG. 5B shows the male fastener 28' of the adjacent cladding element 20' positioned just beyond the mouth of the slot 27 for increasing the lateral coverage of the cladding element 20' over the post "P". For example, in one embodiment of the invention, the cladding assembly 10 is made to fit a 6" square wood post with a dimension error of about +–0.50 inches. In this case, the slot 27 of the female fastener 26 is formed to receive 0.50 inches, more or less, of the adjacent male fastener 28' in the adjustment zone "z" to provide a complete and proper fit of the cladding element 20' over the side of the post "P" being covered.

Figure 4:
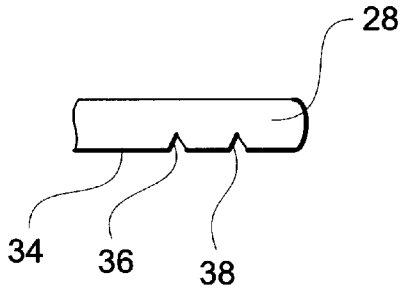
FIG. 4 is an enlarged view of the integrally-formed male fastener of the post cladding element.

As shown in FIG. 4, for added size adjustment, the male fastener 28 may include spaced longitudinally-extending grooves 36 and 38 which define respective weakness lines for being cut to shorten the lateral dimension of the cladding element 20. The grooves 36, 38 preferably extend the entire length of the panel 22 from one end edge the other.

An attachment flange 42A, B, C, D is integrally-formed with the female fastener 26, and extends generally perpendicular to the plane of the panel 22 for receiving nails "N" (See FIG. 6) or other suitable attachment means, such as tacks, staples, or the like. The nails N pass through the attachment flange 42 and into the post "P" to permanently attach the cladding element 20 to the post "P".

Application of the Cladding Assembly 10 to the Post

Figure 6:
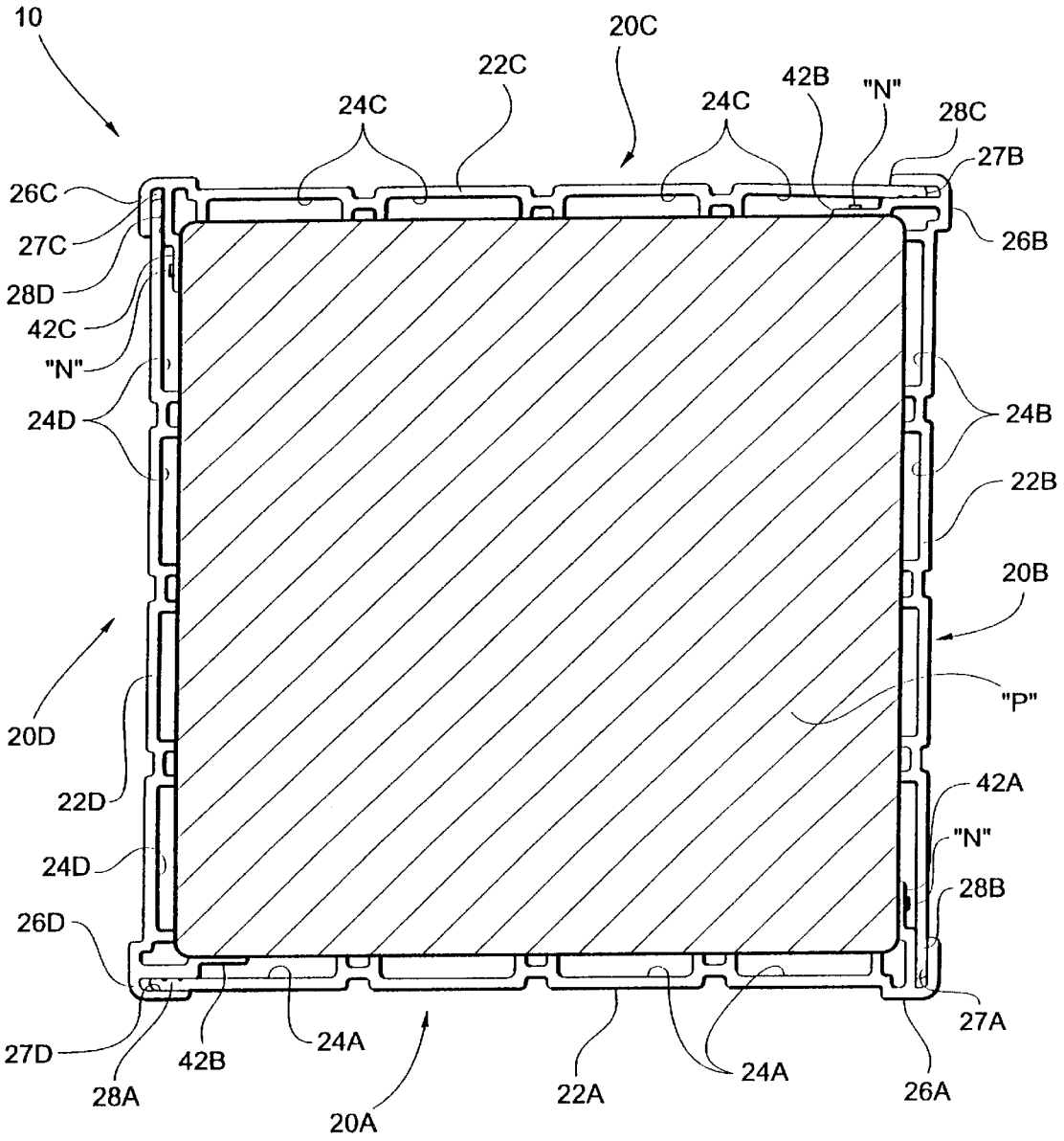
FIG. 6 is a top plan view of the cladding assembly attached to the post.

Referring now to FIGS. 1 and 6, the cladding assembly 10 preferably includes four interconnected, modular post cladding elements 20A, 20B, 20C, and 20D, as described above, which cooperate to completely cover each side of the square post "P". A first cladding element 20A is positioned adjacent one side of the post "P", and is permanently attached using nails "N" or other attachment means driven through the attachment flange 42A into the post "P". The channels 24A formed in the panel 22A extend the entire length of the post "P" to allow air circulation and water drainage in the space between the cladding element 20A and post "P".

The second cladding element 20B is then positioned adjacent to a second side of the post "P", and its male fastener 28B inserted into the slot 27A of the female fastener 26A of the first cladding element 20A. The second cladding element 20B is permanently attached, as described above, using one or more nails "N" driven through the attachment flange 42B and into the post "P". The channels 24B formed in the panel 22B extend the entire length of the post "P" to allow air circulation and water drainage in the space between the cladding element 20B and post "P".

The third cladding element 20C is then positioned adjacent to the third side of the post "P", and its male fastener 28C inserted into the slot 27B of the female fastener 26B of the second cladding element 20B. The third cladding element 20C is likewise permanently attached using nails "N" driven through the attachment flange 42C and into the post "P". The channels 24C formed in the panel 22C extend the entire length of the post "P" to allow air circulation and water drainage in the space between the cladding element 20C and post "P".

The fourth and final cladding element 20D is then positioned adjacent to the fourth side of the post "P". The male fastener 28D of the fourth cladding element 20D is inserted into the slot 27C of the female fastener 26C of the third cladding element 20C, while the female fastener 26D of the fourth cladding element 20D receives the male fastener 28A of the first cladding element 20A. The fourth cladding element 20D is preferably attached using a suitable adhesive applied to the attachment flange 42D for adhering the flange 42D to the post "P". The channels 24D formed in the panel 22D extend the entire length of the post "P" to allow air circulation and water drainage in the space between the cladding element 20D and post "P".

Each of the nails "N" and adhesive used for permanently attaching the cladding elements 20A–20D to the post are concealed upon application of the cladding assembly 10 to the post "P". The length of the cladding elements 20A–20D is readily modified as required using an electric circular saw or hand saw to accommodate the height of the post being covered. For especially tall posts, two or more lengths of cladding elements 20 may be applied end-to-end to cover a single side of the post.

Description Molding 50

Referring to FIGS. 1 and 7–10, to further enhance the appearance of the post "P", decorative molding 50 is applied around the base and/or top of the post "P". The molding 50 is preferably assembled in four separate L-shaped, hollow molding sections 50A, 50B, 50C (not shown), and 50D, each being identical to the other. The molding section 50A is described further below.

Figure 7:
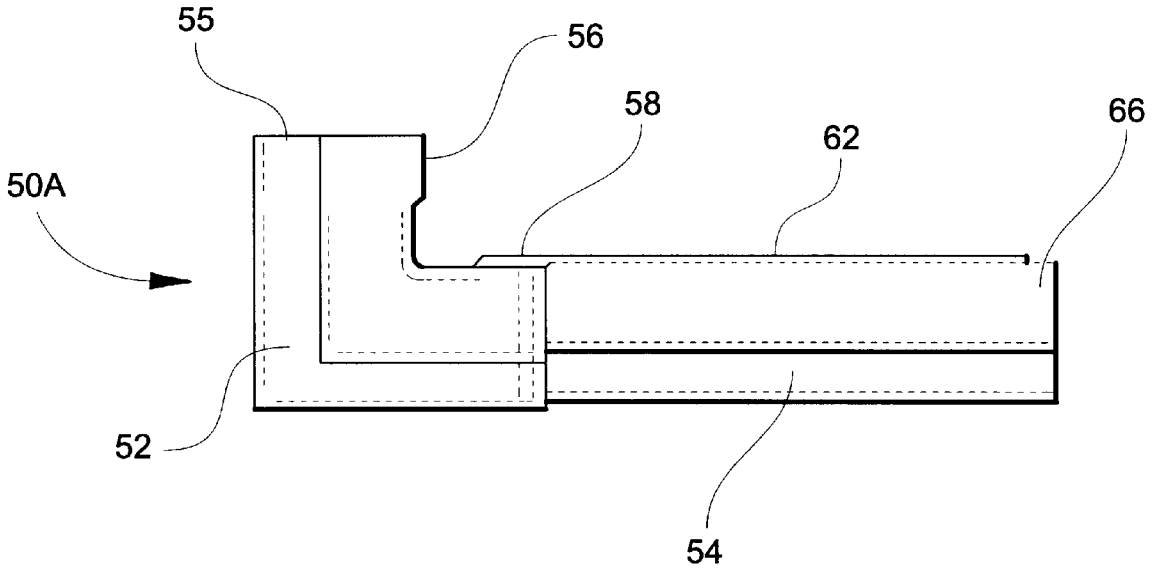
FIG. 7 is a top plan view of a single molding section.

As shown in FIG. 7, the molding section 50A includes an integrally-formed corner 52 and leg 54. The corner 52 defines an opening 55 arranged perpendicular to the leg 54 and shaped to receive the end of a leg of an adjacent molding section 50B (See FIG. 1). A pair of attachment tabs 56 and 58 are formed with the corner 52 for receiving nails or other fasteners through the cladding elements 20A and 20B and into adjacent sides of the post "P".

Figure 8:
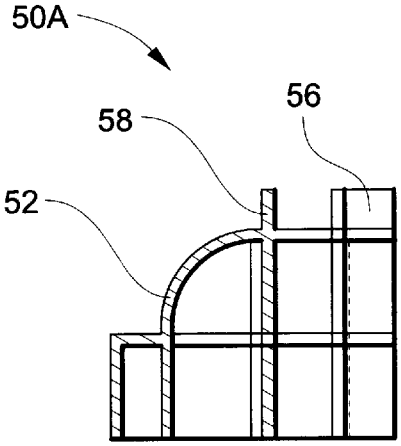
FIG. 8 is a cross-sectional view of the molding section taken substantially along line 8—8 of FIG. 7.
Figure 9:
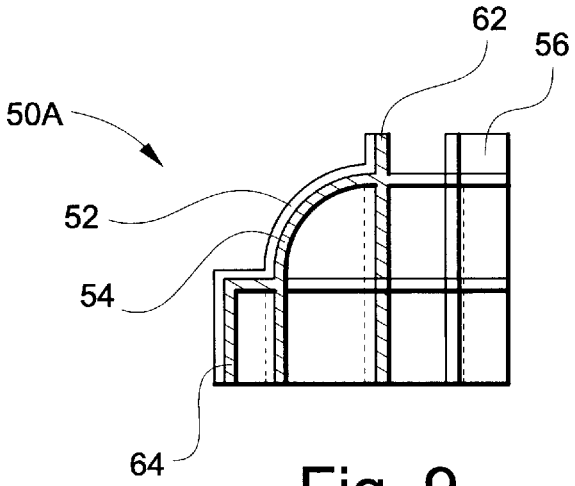
FIG. 9 is a cross-sectional view of the molding section taken substantially along line 9—9 of FIG. 7.
Figure 10:
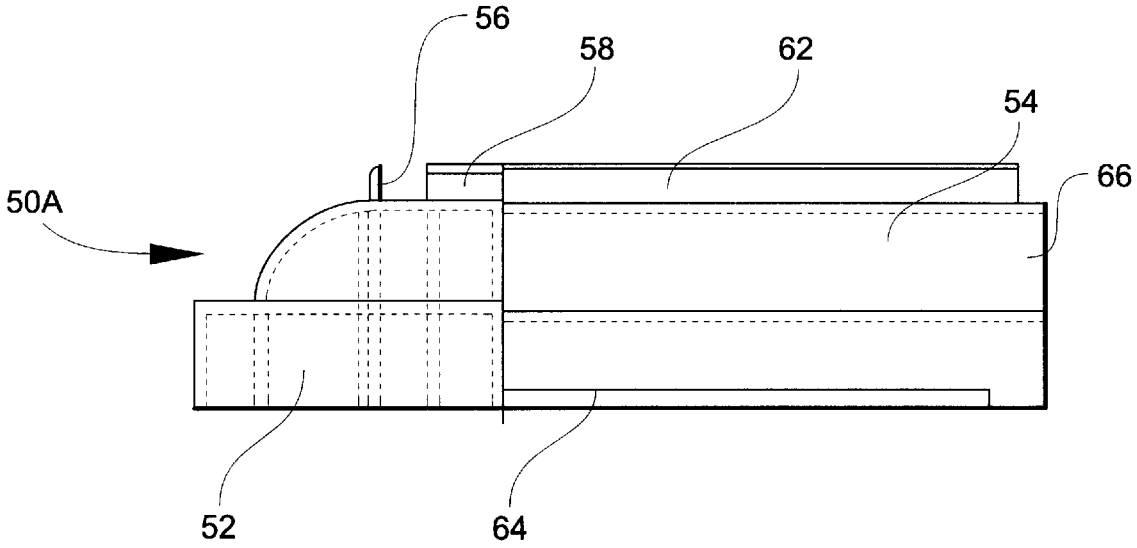
FIG. 10 is a side elevational view of the molding section.

As best shown in FIGS. 8–10, the integrally-formed leg 54 of the molding section 50A includes a flange 62 extending along its length adjacent the attachment tab 58 of the corner 52, and a longitudinal cut-out 64 extending along a side edge opposite the flange 62. The cut-out allows water drainage outwardly from the molding 50.

The molding 50 is applied to the post "P", after attachment of the cladding elements 20A–20D as described above, by mating the corner of one molding section with the leg of another molding section. As best shown in FIGS. 7 and 10, the end of the leg 54 includes an integrally-formed extension 66 which projects slightly beyond the flange 62 for being received into the opening of the hollow corner of the adjacent molding section. Once all four sections 50A–50D are joined together around the post "P", nails or other fasteners are driven through the attachment tabs 56 and 58, through the cladding elements 20A–20D and into the post "P" to permanently attach the molding 50 to the post "P". The extension 66 of each of the molding sections 50A–50D allows for slight size adjustment of the molding 50 in order to properly fit the molding 50 around the particular post "P".

For fence posts and posts used for supporting docks and piers, a molded cap may also be used to complete application of the cladding assembly 10 around the post "P". The molding and cap are preferably formed of PVC plastic.

A post cladding assembly, modular post cladding element, and method of cladding a post are described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A method of cladding a post, comprising the steps of:

(a) forming a post cladding element comprising:

i. a panel for being applied to the post, and having first and second opposed end edges and first and second opposed, longitudinally-extending side edges;

ii. a female fastener extending along the first side edge of said panel; and iii. a complementary male fastener extending along the opposed second side edge of said panel; and (iv) said female fastener comprising spaced-apart surfaces forming a generally U-shaped slot, said slot having a depth at least twice as great as a width of said slot to define a position adjustment zone for receiving therein a selected portion of a male fastener of an adjacent cladding element to position the adjacent cladding element on the post;

(b) applying at least two of said post cladding elements to the post such that the female fastener along the first side edge of one cladding element is adjacent the male fastener along the second side edge of the other cladding element; and (c) locking respective male and female fasteners of the adjacent cladding elements together on the post.

2. A method according to claim 1, and comprising the step of applying decorative molding to a top of the post adjacent the first end edge of each cladding element.

3. A method according to claim 1, and comprising the step of applying decorative molding to a bottom of the post adjacent the second end edge of each cladding element.

* * * * *

US005956920C1

(12) EX PARTE REEXAMINATION CERTIFICATE (5855th)

United States Patent
Davis

(10) Number: US 5,956,920 C1
(45) Certificate Issued: Aug. 14, 2007

(54) MODULAR POST CLADDING ELEMENT, POST CLADDING ASSEMBLY, AND METHOD OF CLADDING A POST

(75) Inventor: Harry H. Davis, Mooresville, NC (US)

(73) Assignee: L.B. Plastics Inc., Mooresville, NC (US)

Reexamination Request:
No. 90/007,034, May 7, 2004

Reexamination Certificate for:

| | |
|---|---|
| Patent No.: | **5,956,920** |
| Issued: | **Sep. 28, 1999** |
| Appl. No.: | **08/917,409** |
| Filed: | **Aug. 25, 1997** |

(51) Int. Cl.
*E04C 3/30* (2006.01)

(52) U.S. Cl. ..... 52/736.3; 52/236.1; 52/588.1
(58) Field of Classification Search ..... None
See application file for complete search history.

(56) References Cited

U.S. PATENT DOCUMENTS

| | | | | | |
|---|---|---|---|---|---|
| 3,368,315 | A | * | 2/1968 | Thurnau | 52/588.1 |
| 4,266,381 | A | * | 5/1981 | Deller | 52/177 |
| 4,905,442 | A | * | 3/1990 | Daniels | 52/588.1 |
| 4,951,992 | A | * | 8/1990 | Hockney | 296/204 |
| 5,480,126 | A | | 1/1996 | Teasdale | |
| 5,647,184 | A | * | 7/1997 | Davis | 52/592.1 |
| D435,670 | S | * | 12/2000 | Crish et al. | D25/124 |
| 6,226,950 | B1 | * | 5/2001 | Davis | 52/592.1 |
| 6,295,783 | B1 | * | 10/2001 | Davis | 52/736.3 |
| 6,412,250 | B2 | * | 7/2002 | Davis | 52/736.3 |
| 6,584,748 | B2 | * | 7/2003 | Bresnahan | 52/650.3 |

FOREIGN PATENT DOCUMENTS

| | | | |
|---|---|---|---|
| CA | 1298057 | | 3/1992 |
| CA | 2326252 | * | 3/2001 |
| CA | 2238453 | * | 12/2001 |

* cited by examiner

*Primary Examiner*—Beverly M. Flanagan

(57) ABSTRACT

An elongate modular post cladding element for being assembled with a plurality of like elements to cover a post. The cladding element includes a panel for being applied to one side of the post, and having first and second opposed end edges and first and second opposed, longitudinally-extending side edges. A female fastener extending along the first side edge of the panel. A complementary male fastener extends along the opposed second side edge of the panel, and is adapted for cooperating with a female fastener of a like, adjacent cladding element for locking the two cladding elements together on the post.

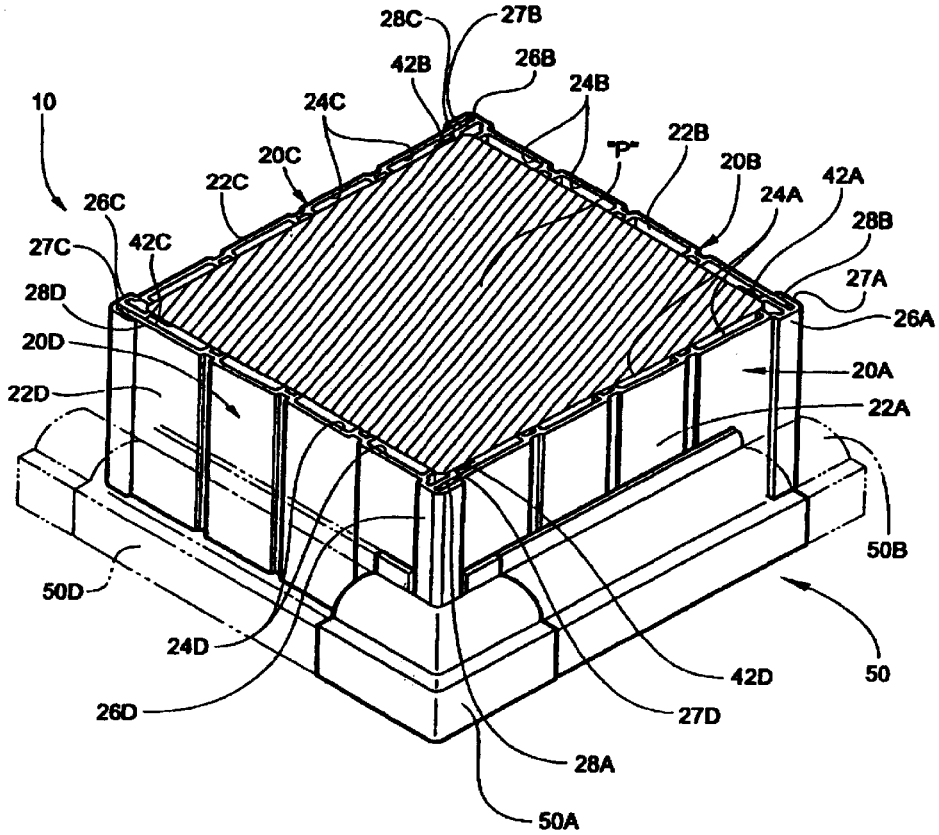

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 are cancelled.

New claims 4–13 are added and determined to be patentable.

*4. A method of cladding a four-sided post, comprising the steps of:*

(*a*) *forming a plurality of post cladding elements, each of the post cladding elements comprising:*

(*i*) *a panel for being applied to the post, the panel having first and second opposed end edges, first and second opposed longitudinally-extending side edges, and at least one spacer integrally-formed with the panel for cooperating with the post to define a longitudinally-extending channel for air circulation and water drainage between the cladding element and the post;*

(*ii*) *a female fastener extending along the first side edge of the panel;*

(*iii*) *a complementary male fastener extending linearly along the opposed second side edge of the panel in the same plane as the panel; and*

(*iv*) *the female fastener comprising spaced-apart parallel surfaces forming a generally U-shaped slot, wherein the slot is positioned perpendicular to the panel and has a depth at least twice as great as a width of the slot to define a position adjustment zone for receiving therein a selected portion of a male fastener of an adjacent cladding element to position the adjacent cladding element on the post, the position adjustment zone having at least two locking positions spaced-apart along the depth for engagement with the selected portion of the male fastener; and*

(*b*) *applying four cladding elements to the post, each of the cladding elements being applied adjacent to a respective side of the post;*

(*c*) *positioning the complementary male fastener of each cladding element into the female fastener of a respective adjacent cladding element;*

(*d*) *adjusting each of the complementary male fasteners within the respective female fastener of the adjacent cladding element on the post to obtain an accurate fit accommodating any variation in the width of the sides of the post; and*

(*e*) *locking each of the complementary male fasteners within the respective female fastener of the adjacent cladding element in the accurate fit position.*

*5. The method according to claim 4, and further comprising the step of attaching each of the post cladding elements to the post.*

*6. A method of cladding a post, comprising the steps of:*

(*a*) *forming a plurality of post cladding elements, each of the post cladding elements comprising:*

(*i*) *a panel for being applied to the post, the panel having first and second opposed end edges, first and second opposed longitudinally-extending side edges, and at least one spacer integrally-formed with the panel for cooperating with the post to define a longitudinally-extending channel for air circulation and water drainage between the cladding element and the post;*

(*ii*) *a female fastener extending along the first side edge of the panel;*

(*iii*) *a complementary male fastener extending linearly along the opposed second side edge of the panel in the same plane as the panel;*

(*iv*) *an attachment flange carried by the female fastener projecting outwardly therefrom for residing next to and being attached to the post to maintain position of the panel on the post; and*

(*v*) *the female fastener comprising spaced-apart parallel surfaces forming a generally U-shaped slot, wherein the slot is positioned perpendicular to the panel and has a depth at least twice as great as a width of the slot to define a position adjustment zone for receiving therein a selected portion of a male fastener of an adjacent cladding element to position the adjacent cladding element on the post; and*

(*b*) *applying a first cladding element adjacent to a first side of the post;*

(*c*) *attaching the first cladding element to the first side of the post;*

(*d*) *applying a second cladding element adjacent to a second side of the post and positioning a male fastener of the second cladding element into a respective female fastener of the first cladding element;*

(*e*) *making a first adjustment of the male fastener of the second cladding element within the respective female fastener of the first cladding element for adjusting the second cladding element on the second side of the post;*

(*f*) *locking the male fastener of the second cladding element within the respective female fastener of the first cladding element;*

(*g*) *attaching the second cladding element to the second side of the post;*

(*h*) *applying a third cladding element adjacent to a third side of the post and positioning a male fastener of the third cladding element into a respective female fastener of the second cladding element;*

(*i*) *making a second adjustment of the male fastener of the third cladding element within the respective female fastener of the second cladding element for adjusting the third cladding element on the third side of the post;*

(*j*) *locking the male fastener of the third cladding element within the respective female fastener of the second cladding element;*

(*k*) *attaching the third cladding element to the third side of the post;*

(*l*) *applying a fourth cladding element adjacent to a fourth side of the post and positioning a male fastener of the fourth cladding element into a respective female fastener of the third cladding element;*

(*m*) *making a third adjustment of the male fastener of the fourth cladding element within the respective female fastener of the third cladding element for adjusting the fourth cladding element on the fourth side of the post;*

(n) *locking the male fastener of the fourth cladding element within the respective female fastener of the third cladding element;*

(o) *positioning a male fastener of the first cladding element into a respective female fastener of the fourth cladding element;*

(p) *making a fourth adjustment of the male fastener of the first cladding element within the respective female fastener of the fourth cladding element for adjusting the fourth cladding element on the fourth side of the post;*

(q) *locking the male fastener of the first cladding element within the respective female fastener of the fourth cladding element; and*

(r) *attaching the fourth cladding element to the fourth side of the post.*

*7. The method according to claim 4, wherein the width of the slot is substantially the same as a thickness of the male fastener to resist withdrawal of the selected portion of the male fastener from the female fastener.*

*8. The method according to claim 4, wherein the adjustment zone includes an array of serrations positioned along at least one of the parallel surfaces of the U-shaped slot, the serrations defining the at least two locking positions.*

*9. A method of cladding a four-sided post, comprising the steps of:*

(a) *forming a plurality of post cladding elements, each of the post cladding elements comprising:*

(i) *a panel for being applied to the post, the panel having first and second opposed end edges, first and second opposed longitudinally-extending side edges, and at least one spacer integrally-formed with the panel for cooperating with the post to define a longitudinally-extending channel for air circulation and water drainage between the cladding element and the post;*

(ii) *a female fastener extending along the first side edge of the panel, the female fastener comprising spaced-apart parallel surfaces forming a generally U-shaped slot, wherein the slot is positioned perpendicularly to the panel and has a depth at least twice as great as a width of the slot to define a position adjustment zone along the depth for receiving therein a selected portion of a male fastener of an adjacent cladding element to position the adjacent cladding element on the post;*

(iii) *a complementary male fastener extending linearly along the opposed second side edge of the panel in the same plane as the panel, the male fastener being adapted to be locked in at least two different positions along a depth of a position adjustment zone of a female fastener of an adjacent cladding element;*

(b) *applying four cladding elements to the post, each of the cladding elements being applied adjacent to a respective side of the post;*

(c) *positioning the complementary male fastener of each cladding element into the female fastener of a respective adjacent cladding element;*

(d) *adjusting each of the complementary male fasteners within the respective female fastener of the adjacent cladding element on the post to obtain an accurate fit accommodating any variation in the width of the sides of the post; and*

(e) *locking each of the complementary male fasteners within the respective female fastener of the adjacent cladding element in the accurate fit position.*

*10. The method according to claim 9, and further comprising the step of attaching each of the post cladding elements to the post.*

*11. The method according to claim 9, wherein the width of the slot is substantially the same as a thickness of the male fastener to resist withdrawal of the selected portion of the male fastener from the female fastener.*

*12. The method according to claim 9, wherein the complementary male fastener includes an array of serrations for engagement with the female fastener of an adjacent cladding element.*

*13. The method according to claim 9, wherein the female fastener includes an array of serrations along the depth of the female fastener for engagement with a selected portion of the male fastener of an adjacent cladding element so as to allow the selected portion of the male fastener to be secured at a selected location along the depth of the slot.*

* * * * *